US012805598B2

(12) United States Patent
Susko et al.

(10) Patent No.: US 12,805,598 B2
(45) Date of Patent: Nov. 24, 2026

(54) VARIABLE FRICTION SHOE

(71) Applicant: THE REGENTS OF THE UNIVERSITY OF CALIFORNIA, Oakland, CA (US)

(72) Inventors: Tyler Susko, Oakland, CA (US); Elliot Hawkes, Goleta, CA (US); Erinn Sloan, Oak Park, CA (US); Matthew Ryan Devlin, San Diego, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 0 days.

(21) Appl. No.: 18/799,480

(22) Filed: Aug. 9, 2024

(65) Prior Publication Data

US 2024/0398061 A1 Dec. 5, 2024

Related U.S. Application Data

(63) Continuation of application No. 17/600,930, filed as application No. PCT/US2020/026881 on Apr. 6, 2020, now Pat. No. 12,082,641.

(60) Provisional application No. 62/829,254, filed on Apr. 4, 2019.

(51) Int. Cl.

| | |
|---|---|
| ***A43B 13/12*** | (2006.01) |
| ***A43B 13/16*** | (2006.01) |
| ***A43B 13/18*** | (2006.01) |
| ***A43B 13/26*** | (2006.01) |
| ***A43B 23/02*** | (2006.01) |

(52) U.S. Cl.

CPC ..... *A43B 13/122* (2013.01); *A43B 13/16* (2013.01); *A43B 13/186* (2013.01); *A43B 13/26* (2013.01); *A43B 23/025* (2013.01); *A43B 23/0265* (2013.01)

(58) Field of Classification Search

CPC ..... A43B 13/122; A43B 13/16; A43B 13/22; A43B 13/24; A43B 13/12

USPC ..... 36/25 R

See application file for complete search history.

(56) References Cited

U.S. PATENT DOCUMENTS

| | | | | |
|---|---|---|---|---|
| 3,195,244 | A | 7/1965 | Whitcas | |
| 3,672,077 | A | 6/1972 | Coles | |
| 4,056,106 | A | 11/1977 | Salvatore | |
| 4,083,125 | A * | 4/1978 | Benseler ..... | A43B 7/081 36/32 R |

(Continued)

FOREIGN PATENT DOCUMENTS

| | | | |
|---|---|---|---|
| EP | 3945924 | A1 | 2/2022 |
| JP | 11137305 | H | 5/1999 |

(Continued)

OTHER PUBLICATIONS

"Extended European Search Report Mailed on Dec. 5, 2022", 7 Pages.

(Continued)

*Primary Examiner* — Marie D Bays
(74) *Attorney, Agent, or Firm* — Billion & Armitage

(57) ABSTRACT

A variable friction shoe includes a midsole and an outsole. The outsole includes at least a first high-friction surface and at least a first low-friction surface, wherein the first low-friction surface remains prominent if vertical ground reaction forces (GRFs) are low and wherein the high-friction surface is prominent in response to increasing GRFs.

15 Claims, 8 Drawing Sheets

(56) References Cited

U.S. PATENT DOCUMENTS

| | | | | |
|---|---|---|---|---|
| 4,141,158 | A * | 2/1979 | Benseler | A43B 13/223 D2/954 |
| 4,667,423 | A * | 5/1987 | Autry | A43B 17/02 36/102 |
| 5,077,915 | A * | 1/1992 | Gross | A43B 13/12 36/31 |
| 5,926,974 | A | 7/1999 | Friton | |
| 6,243,973 | B1 | 6/2001 | Lind | |
| 6,589,630 | B1 * | 7/2003 | Crow | C08L 9/00 36/43 |
| 8,813,394 | B2 | 8/2014 | Weidman et al. | |
| 8,844,170 | B2 | 9/2014 | Ferrigan et al. | |
| 9,049,900 | B1 | 6/2015 | Cox et al. | |
| 9,439,474 | B2 | 9/2016 | Braunschweiler | |
| 9,572,401 | B1 * | 2/2017 | Haskins | A43B 5/002 |
| 2004/0055181 | A1 | 3/2004 | Gallegos | |
| 2004/0055182 | A1 * | 3/2004 | Manz | A43B 13/18 36/115 |
| 2006/0143947 | A1 * | 7/2006 | Ellis | A43B 13/26 36/30 R |
| 2006/0277799 | A1 * | 12/2006 | Lebo | A43B 13/141 36/102 |
| 2008/0110045 | A1 | 5/2008 | Terlizzi et al. | |
| 2010/0024252 | A1 | 2/2010 | Sveen | |
| 2010/0107448 | A1 | 5/2010 | Woo et al. | |
| 2011/0302806 | A1 * | 12/2011 | Auger | A43B 13/40 36/44 |
| 2012/0144695 | A1 | 6/2012 | Mcdowell et al. | |
| 2012/0233885 | A1 | 9/2012 | Shaffer et al. | |
| 2012/0255204 | A1 | 10/2012 | Iglesias et al. | |
| 2012/0260535 | A1 | 10/2012 | Tsang | |
| 2012/0266500 | A1 | 10/2012 | Cobb | |
| 2013/0000153 | A1 | 1/2013 | Weidman et al. | |
| 2013/0036633 | A1 | 2/2013 | Lee | |
| 2013/0263469 | A1 | 10/2013 | Braunschweiler | |
| 2013/0263476 | A1 | 10/2013 | Santos et al. | |
| 2014/0283413 | A1 * | 9/2014 | Christensen | A43B 13/20 36/102 |
| 2014/0310986 | A1 | 10/2014 | Tamm et al. | |
| 2015/0196082 | A1 | 7/2015 | Van Atta | |
| 2015/0196087 | A1 | 7/2015 | Meschter et al. | |
| 2015/0237958 | A1 * | 8/2015 | Cross | A43B 13/125 36/103 |
| 2015/0335095 | A1 | 11/2015 | Lee | |
| 2016/0192739 | A1 * | 7/2016 | Hoffer | A43B 13/188 36/28 |
| 2016/0219980 | A1 * | 8/2016 | Taylor | A43B 13/122 |
| 2016/0278484 | A1 * | 9/2016 | Aslani | A43B 5/02 |
| 2016/0331067 | A1 * | 11/2016 | McCaffrey | A43B 3/36 |
| 2017/0042284 | A1 * | 2/2017 | Lawless | A43B 13/181 |
| 2017/0318902 | A1 * | 11/2017 | Schiller | A43B 13/188 |
| 2018/0352906 | A1 | 12/2018 | Miller | |
| 2019/0104806 | A1 * | 4/2019 | Cass | B32B 27/12 |
| 2019/0110553 | A1 * | 4/2019 | Yoshikawa | A43B 13/18 |
| 2019/0223552 | A1 * | 7/2019 | Hollinger | A43B 13/223 |
| 2019/0373980 | A1 | 12/2019 | Mariacher | |
| 2020/0008513 | A1 * | 1/2020 | Yao | A43B 13/187 |
| 2020/0077734 | A1 * | 3/2020 | Bidal | A43B 13/223 |
| 2020/0315293 | A1 | 10/2020 | Zhao et al. | |
| 2021/0015206 | A1 * | 1/2021 | Boys | A43B 13/122 |
| 2021/0267306 | A1 | 9/2021 | Sakaguchi et al. | |
| 2022/0192314 | A1 * | 6/2022 | Susko | A43B 13/26 |

FOREIGN PATENT DOCUMENTS

| | | | |
|---|---|---|---|
| JP | 2013539673 | A | 10/2013 |
| WO | 2017151388 | A1 | 9/2017 |
| WO | 2020206428 | A1 | 10/2020 |

OTHER PUBLICATIONS

"Non-Final Office Action Mailed on Nov. 23, 2022", 3 Pages.
"Notice of Allowance for U.S. Pat. No. 3,134,270 mailed on May 8, 2024", 1.
"Notice of Allowance Received mailed on Aug. 7, 2023", 3 Pages.
"Office action Received mailed on Jul. 27, 2023", 3 Pages.
"PCTUS2245228_PCTIB326_04_11_24", 8 Pages.
PCT/US20/26881 , "International Search Report and Written Opinion", Jul. 16, 2020, 8 Pages.
PCT/US20200/26881 , "International Search Report and Written Opinion", Sep. 9, 2020, 9 pages.
PCT/US22/45228 , "International Search Report and Written Opinion", Dec. 30, 2022, 13 pages.
"Communication Pursuant to Article 94(3) EPC mailed on Dec. 11, 2025", 6 Pages.

* cited by examiner

VARIABLE FRICTION SHOE

CROSS-REFERENCE TO RELATED APPLICATION(S)

This application is a continuation of U.S. patent application Ser. No. 17/600,930, filed Oct. 1, 2021, which is a National Stage Application of International Application No. PCT/US2020/026881 filed Apr. 6, 2020, which claims benefit of U.S. Provisional Application No. 62/829,254, filed on Apr. 4, 2019, titled "VARIABLE FRICTION SHOE", each of which is incorporated herein by reference. A claim of priority is made.

BACKGROUND

The present invention is related to footwear, and in particular to footwear designed to aid those suffering from a condition that makes it difficult to clear the floor during swing such as foot drop.

Foot Drop is a mobility disorder that limits ankle dorsiflexion, complicating the swing phase of gait and balance. It is a common result of a neurological injury or disease such as stroke, cerebral palsy, peripheral nerve disease, brain tumor or multiple sclerosis.

While symptoms of stroke, multiple sclerosis, brain tumors, peripheral nerve disease and cerebral palsy vary from patient to patient, a subset of patients in each group will experience foot drop, characterized by the inability to dorsiflex, or lift the toes toward the shin, due to impaired control of the tibialis anterior and/or the triceps surae. It inhibits the rhythmic swing phase of gait, increases the probability of foot scuff and falls, and forces conscious monitoring of one's gait, typically manifesting into abnormal gait patterns.

Assistive technology refers to devices meant to aid a person in desirable tasks. For walking, available devices include functional electrical stimulation (FES) applied to the tibialis anterior muscle or a static ankle-foot orthosis (AFO). Rehabilitation technology refers to devices meant to restore healthy movement via use of the technology. Robotic rehabilitation devices are beginning to target populations with foot drop. For example, researchers at Massachusetts Institute of Technology (MIT) developed the MIT-Skywalker which allows free motion during the swing phase of gait, temporarily restoring rhythmicity originally lost due to inability to clear the floor. The Skywalker and other robotic rehabilitation devices, while promising, have three areas for improvement: cost, complexity and portability. Rehabilitation is most effective with repetition. A device that a patient could own or at least use regularly outside of clinical visits would allow for a higher volume of rehabilitation training. Currently, there is not a rehabilitative solution that is cost effective and practical for every day independent use.

SUMMARY

According to some aspects, a variable friction shoe includes a midsole and an outsole. The outsole includes at least a first high-friction surface and at least a first low-friction surface, wherein the first low-friction surface remains prominent if vertical ground reaction forces (GRFs) are low and wherein the high-friction surface is prominent in response to increasing GRFs.

DETAILED DESCRIPTION

According to some aspects, a variable friction shoe is disclosed herein that provides variable levels of friction with the ground during various gait stages. For purposes of this discussion, the gait is divided into the swing phase and the stance phase. During the swing phase the variable friction shoe presents a low-friction surface that protrudes or extends from the outsole of the shoe. During the stance phase of the gait the variable friction shoe presents a high-friction surface at the outsole of the shoe to prevent slipping with respect to the ground. In some embodiments, the outsole of the variable friction shoe includes a bottom surface configured to provide contact between the shoe and the ground, wherein the bottom surface is a high-friction surface. For example, the bottom surface may utilize materials and geometries such as tracks to provide a high-friction surface. The outsole further includes one or more columns or islands that retain a compressible material and a low-friction material. During the swing portion of the gait, when vertical ground reaction forces (GRFs) are low, the compressible material is in an uncompressed state allowing the low-friction material to protrude from the high-friction surface of the outsole. During the stance stage of the gait, when vertical GRFs are high, the compressible material is in a compressed state that causes the low-friction material to recede within the high-friction surface of the outsole such that a high-friction surface is put into contact with the ground.

Figure 1A:
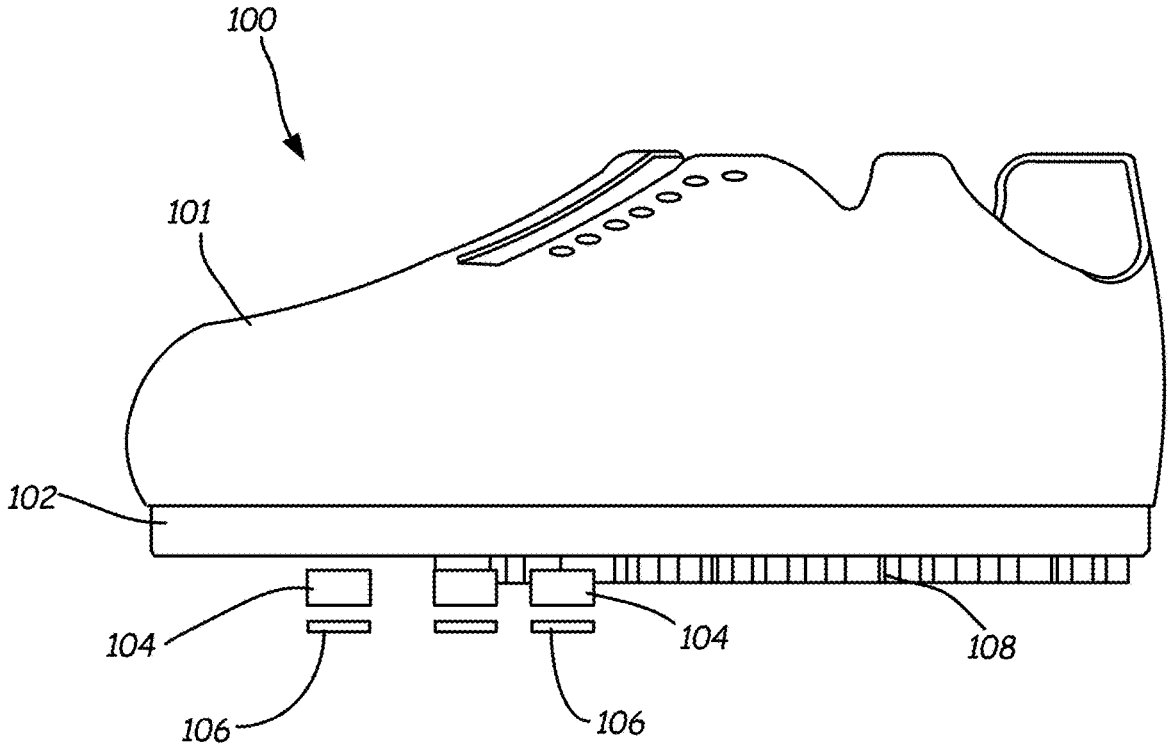
FIGS. 1*a* and 1*b* are side and orthogonal views, respectively, of a variable friction shoe according to some embodiments.
Figure 1B:
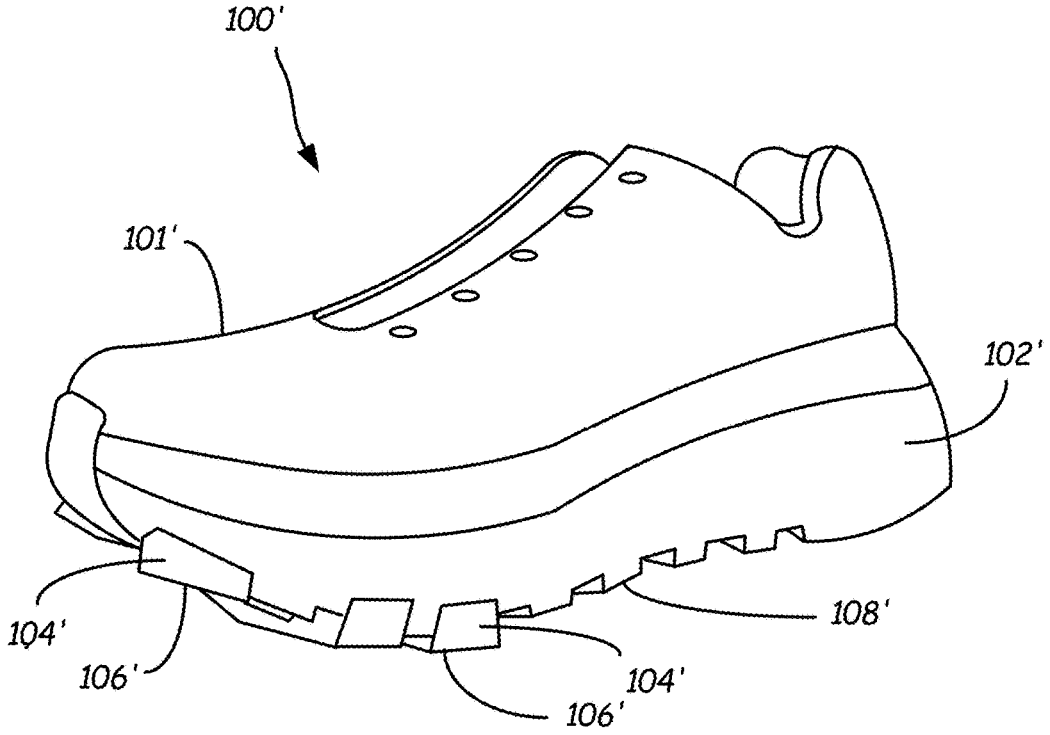

FIGS. 1*a* and 1*b* are side and orthogonal views, respectively, of variable friction shoes according to some embodiments. Variable friction shoe 100 includes a top portion 101, a midsole 102, a high-friction surface 108, a low-friction surface 106, and a compressible material 104. In the embodiment shown in FIG. 1*a*, a plurality of cylindrical pairs of compressible material 104 and low-friction material 106 are shown in an exploded view to illustrate the components utilized. In the embodiment shown in FIG. 1*b*, the plurality of cylindrical pairs of compressible material 108' and low-friction material 106' are shown installed within the high-friction surface 108' of the midsole 102'. In some embodiments, the islands or patches of compressible material 104 and low-friction material 106 are distributed evenly along the bottom of the variable friction shoe 100. In other embodiments the islands or patches of compressible material 104 and low-friction material 106 are placed at locations most likely to come into contact with the ground during the swing phase of the gait. For example, in one embodiment the columns of compressible material 104 and low-friction material 106 are located primarily at the front of the shoe 100 where the shoe is likely to scuff against the ground during the swing phase of gait.

In some embodiments, the compressible material 104 is comprised of a soft elastic foam and the low-friction material 106 is comprised of polytetrafluoroethylene (PTFE). In other embodiments, other materials may be utilized that provide the desired characteristic of compressibility in the compressible material 104 in response to the force exerted during the stance stage and low-friction in the low-friction material to allow the shoe to scuff the ground during the swing stage. In particular, the materials are selected such that the low-friction material 106 remains proud during the swing stage when the vertical GRFs are relatively low, and wherein the low-friction material 106 is compressed by the higher vertical GRFs provided during the stance stage of the gait to allow the high-friction surface 108 to come into contact with the ground (i.e., such that the low-friction material 106 is no longer proud or protruding from the high-friction surface 108).

Figure 2A:
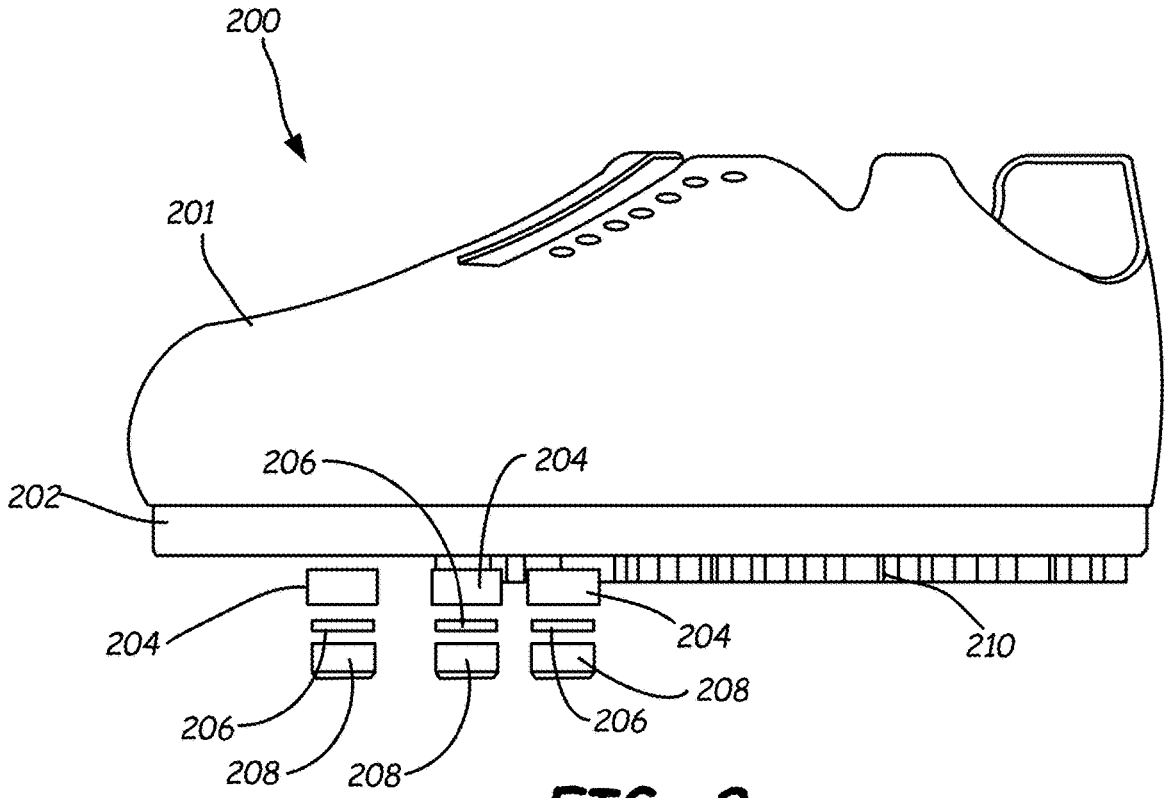
FIGS. 2*a* and 2*b* are side and orthogonal views, respectively, of a variable friction view according to some embodiments.
Figure 2B:
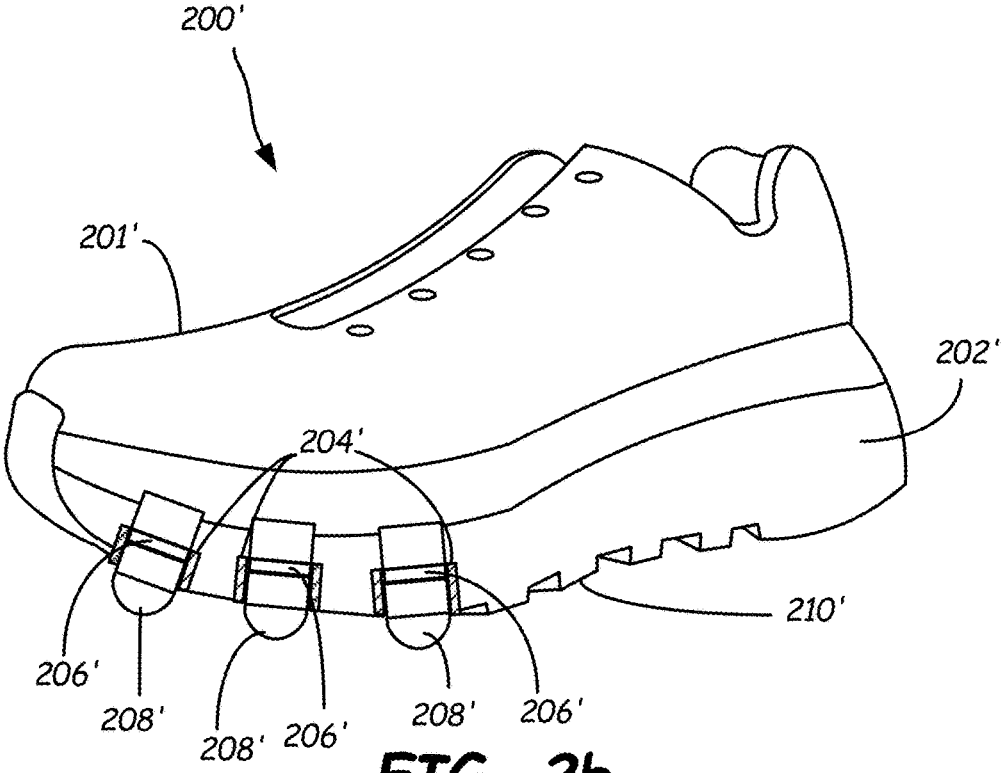

FIGS. 2*a* and 2*b* illustrates side and orthogonal views, respectively, of a variable friction shoe 200 and 200' according to another embodiment of the present invention. The variable friction shoe 200 (as well as 200') once again includes a top portion 201, an outsole 202, a high-friction material 210 and a plurality of islands or patches that include a hollow, cylindrical bushings 204, a compressible material 206 and a low-friction material 208. In the embodiment shown in FIG. 2*a*, the hollow, cylindrical bushings 204, compressible material 206 and low-friction material 208 are shown in an exploded view that illustrates the relative locations of each. In the embodiment shown in FIG. 2*b*, the hollow, cylindrical bushings 204' are shown in a cut-away view that illustrates the location of compressible materials 206' and low-friction material 208' within the hollow, cylindrical bushings 204'. The embodiment shown in FIG. 2*b* also illustrates the relative location of the cylindrical bushings 204', compressible material 206' and low-friction material 208' within the outsole 202' and high-friction surface 210'.

In some embodiments the compressible material 206 and the low-friction material 208 are housed within the hollow, cylindrical bushing 204. In the embodiment shown in FIGS. 2*a* and 2*b*, the low-friction material 208 is comprised of delrin, the compressive material is comprised of soft, elastic foam, and the hollow cylindrical linear bushings 204 are plastic. In other embodiments, other types of materials may be utilized. Once again, materials are selected such that the low-friction material 208 remains proud during the swing stage when the vertical GRFs are relatively low, and wherein the low-friction material 208 is compressed by the higher vertical GRFs provided during the stance stage of the gait to allow the high-friction surface 210 to come into contact with the ground (i.e., such that the low-friction material 208 is no longer proud or protruding from the high-friction surface 210).

Figure 3A:
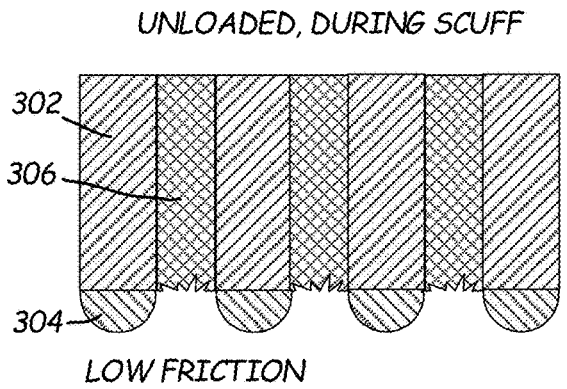
FIGS. 3*a* and 3*b* are cross-sectional views of the variable friction sole in an unloaded state and a loaded state, respectively, according to some embodiments.
Figure 3B:
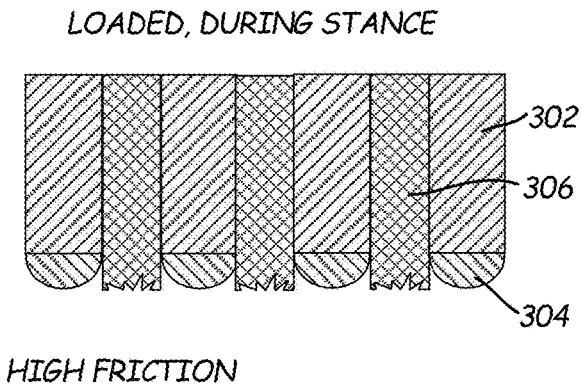

FIGS. 3*a* and 3*b* are cross-sectional views that illustrate the variable friction shoe in an uncompressed state (presumably during the swing stage of the gait) and in a compressed state (presumably during the stance stage of the gait), respectively. Shown in FIGS. 3*a* and 3*b* is a compressible material 302, a low-friction material 304, and a high-stiffness, high-friction material 306. As shown in FIG. 3*a*, during the swing state the vertical GRFs are relatively low, allowing the compressible material 302 to remain largely uncompressed. As a result, the low-friction material 304 protrudes beyond the high-friction surface or high-friction materials 306. During the swing stage of the gait, a person suffering from foot drop may inadvertently allow the shoe to come into contact with the ground during the swing stage. In the event this happens, the low-friction material 304 will come into contact with the ground and allow the shoe to slide over ground rather than catch. As the wearer enters the stance stage of the gait the vertical GRFs increase as the wearer transitions weight to the foot. The increase in vertical GRFs causes the compressible material 302 to compress, which allows the low-friction material 304 to recede such that the high-friction material 306 comes into contact with the ground. In some embodiments, the high-friction material 306 has a stiffness substantially greater than the compressible material 302. In some embodiments, the high-stiffness material 306 is also the high-friction material. In some embodiments, the high-stiffness material 306 is separate from the high-friction material (not labeled) that comes into contact with the ground during the stance stage of the gait. In this embodiment, the high-friction material would be located on the bottom exterior surface of the high-stiffness material 306.

Figure 4A:
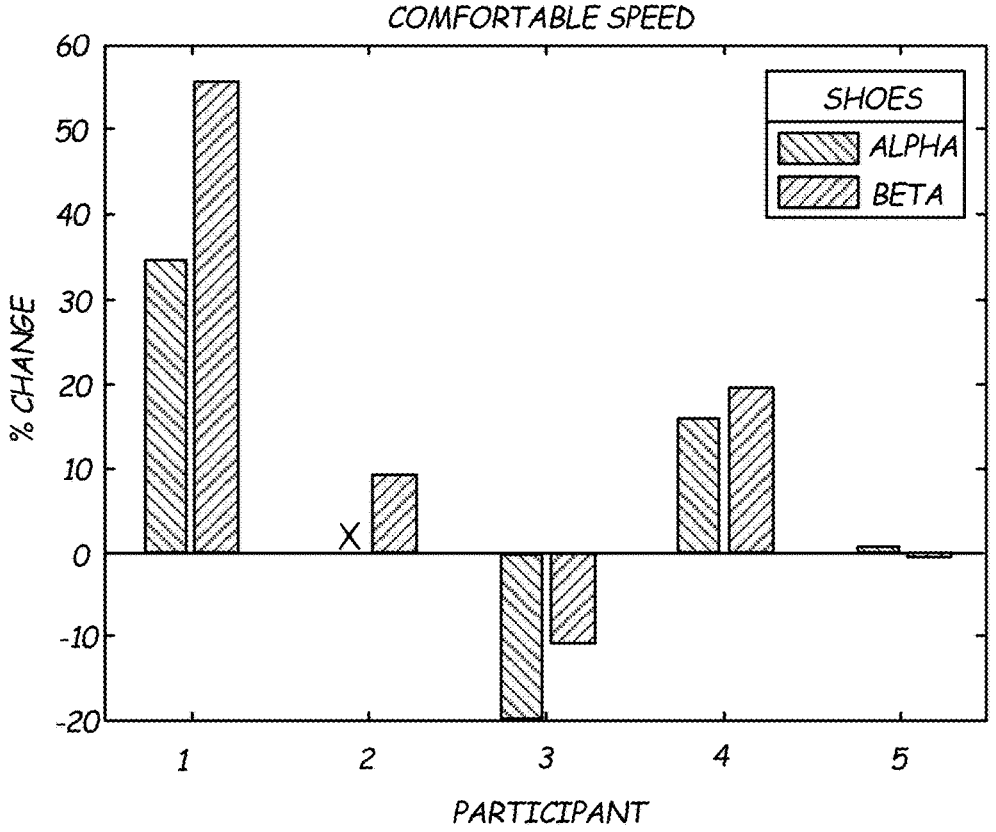
FIGS. 4*a*-4*c* are graphs illustrating performance of the variable friction shoe as compared with a typical show according to some embodiments.
Figure 4B:
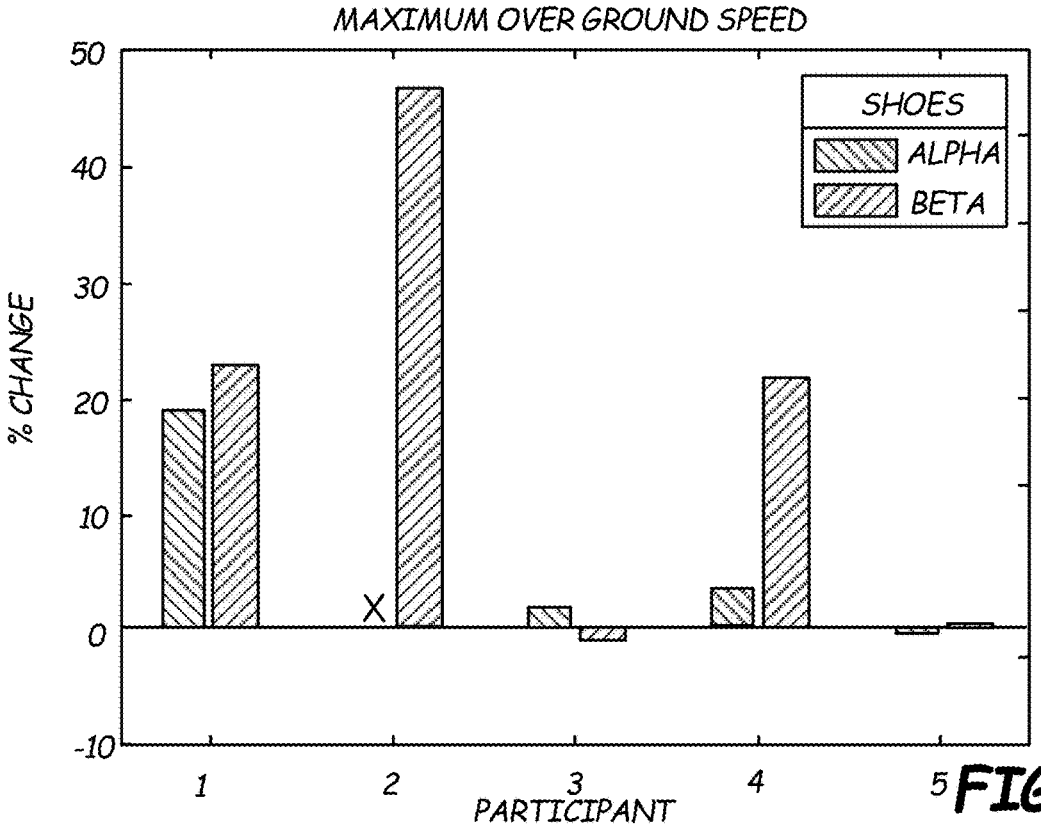
Figure 4C:
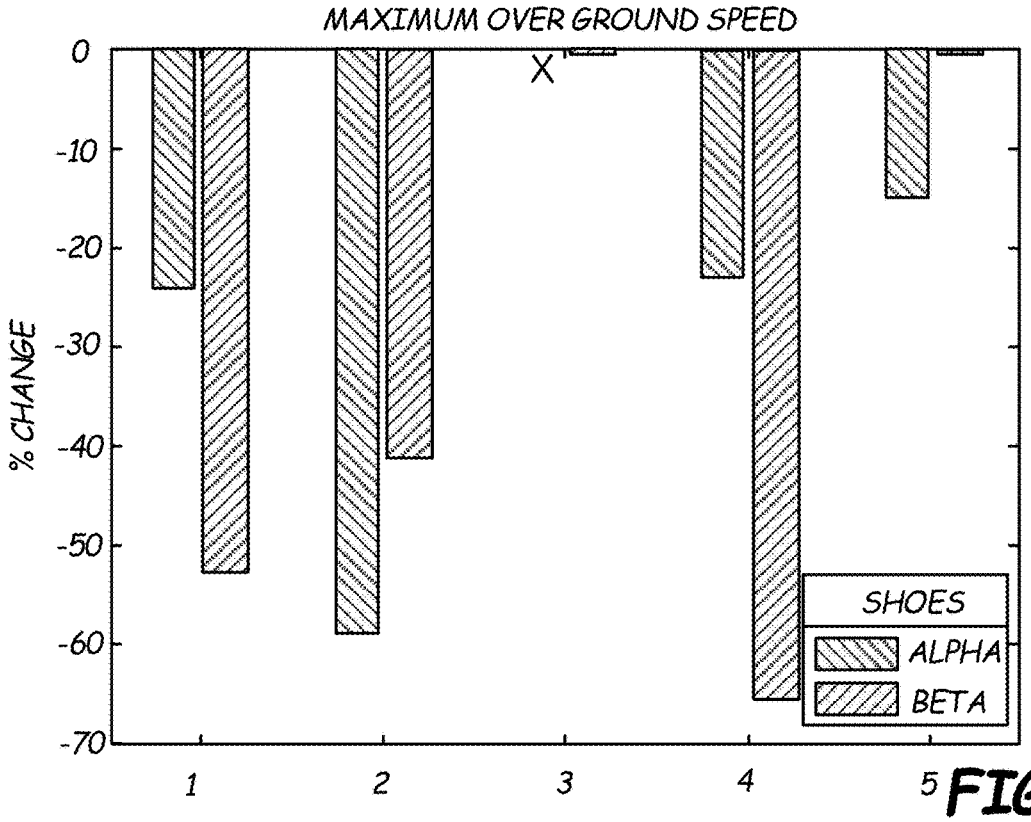

FIGS. 4*a*-4*c* are graphs illustrating patient improvement according to various quantifiable aspects utilizing various embodiments of the present invention. In particular, FIG. 4*a* illustrates percent change in walking speed utilizing various versions of the variable friction shoe; FIG. 4*b* illustrates percent change in maximum over ground speed reached utilizing various versions of the variable friction shoe; and FIG. 4*c* illustrates percent change in hip angle utilizing various versions of the variable friction shoe. Results shown in FIGS. 4*a*-4*c* illustrate tests of first and second models of the variable friction shoe, the first variable friction shoe labeled 400 and the second variable friction shoe labeled 402. The first variable friction shoe utilizes patches having soft elastic foam with a thin layer of low-friction material (for example as shown in FIGS. 1*a*-1*b*). The second variable friction shoe utilizes patches having a delrin peg attached to a soft elastic foam, wherein the delrin pegs are cylindrical with rounded edges and are supported by hollow cylindrical linear bushings.

As shown in FIG. 4*a*, for most participants both the first and second versions of the variable friction shoe provided an improved comfortable walking speed over fixed friction shoes (e.g., normal tennis shoes or sneakers), with the second variable friction shoe showing slightly improved performance as compared with the first variable friction shoe.

Similarly, as shown in FIG. 4*b*, for most participants both the first and second versions of the variable friction shoe provided an improved maximum over ground speed over fixed friction shoes (e.g., controlled running sneakers with the same geometry as the variable friction shoes), with the second variable friction shoe showing improved performance as compared with the first variable friction shoe.

FIG. 4*c* illustrates that the hip angle of the participants decreased for most participants utilizing both the first and second versions of the variable friction shoe. In order to advance gait, some impaired individuals adopt a circumduction gate. For these individuals, greater frontal plane hip angles represent greater compensation and thus higher levels of physical exertion. While both versions of the shoe improved hip angles, the second version provided slightly better performance by decreasing frontal plane hip angles.

Figure 5A:
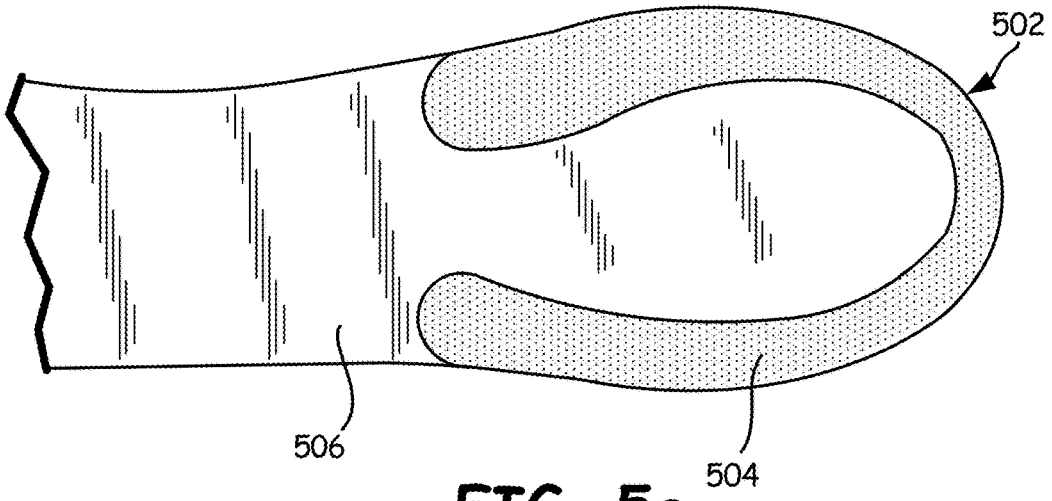
FIG. 5*a* is a bottom view of a variable friction shoe according to some embodiments.
Figure 5B:
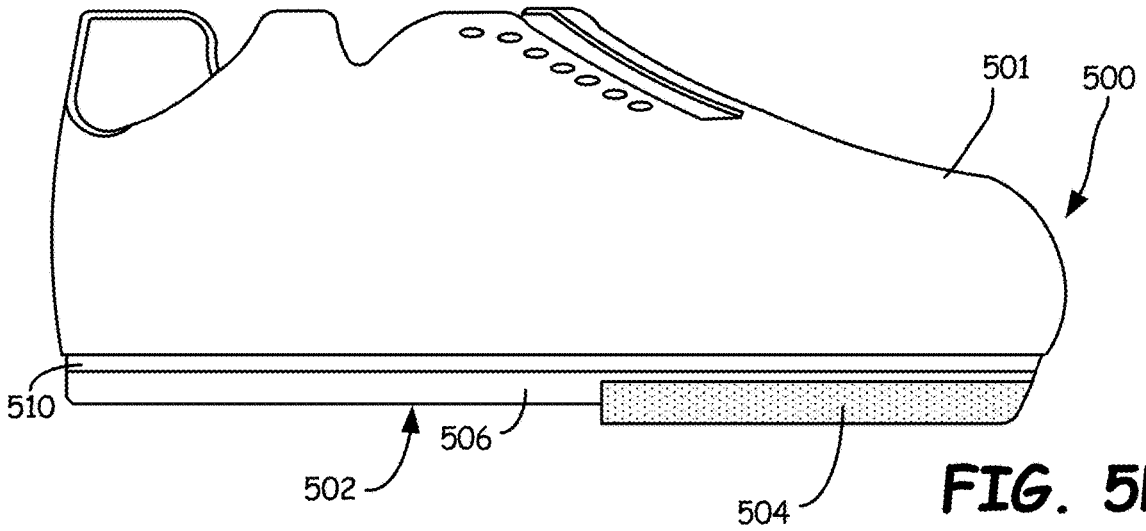
FIGS. 5*b* and 5*c* are side views of the variable friction shoe in an uncompressed state and a compressed state, respectively, according to some embodiments.
Figure 5C:
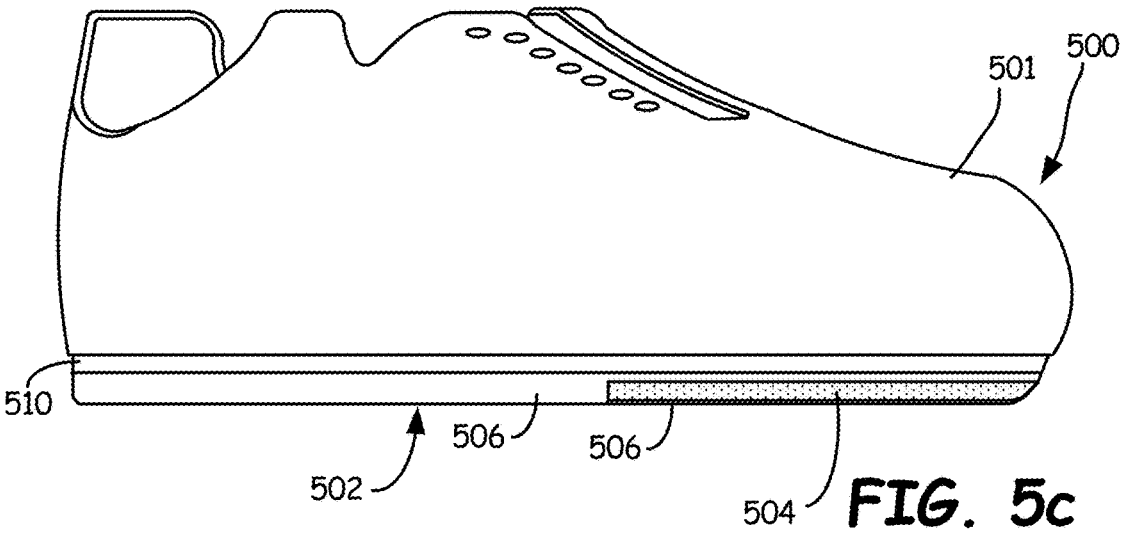

Referring now to FIGS. 5*a*-5*c*, a variable friction shoe 500 is illustrated according to some embodiments. In particular, FIG. 5*a* is a bottom view of the variable friction shoe 500, FIG. 5*b* is a side view of the variable friction shoe 500 in an uncompressed state (presumably during the swing stage of the gait) and FIG. 5*c* is a side view of the shoe 500 in a compressed state (presumably during the stance stage of the gait).

Figure 6:
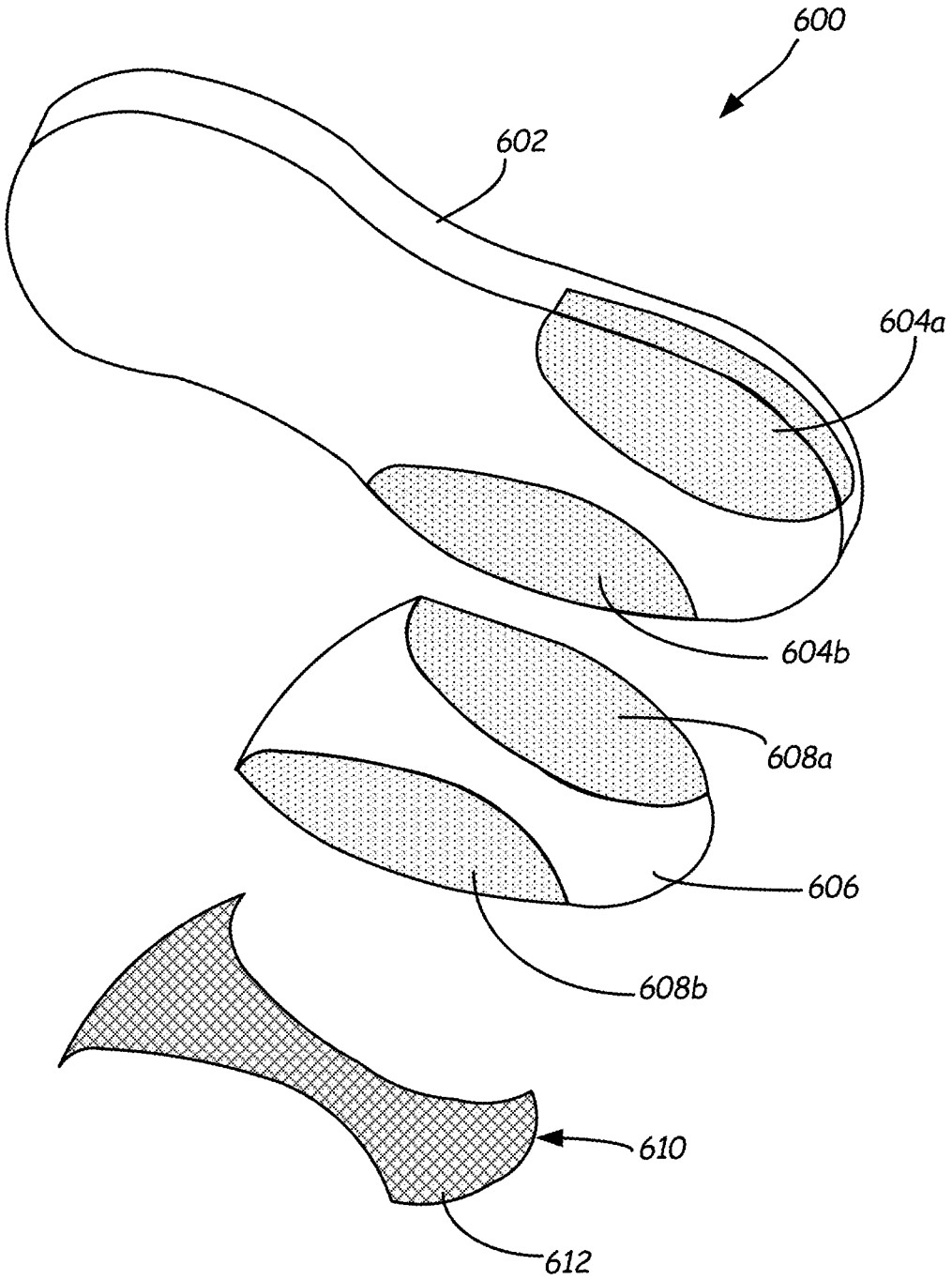
FIG. 6 is an exploded view of a variable friction shoe according to some embodiments.
Figure 7A:
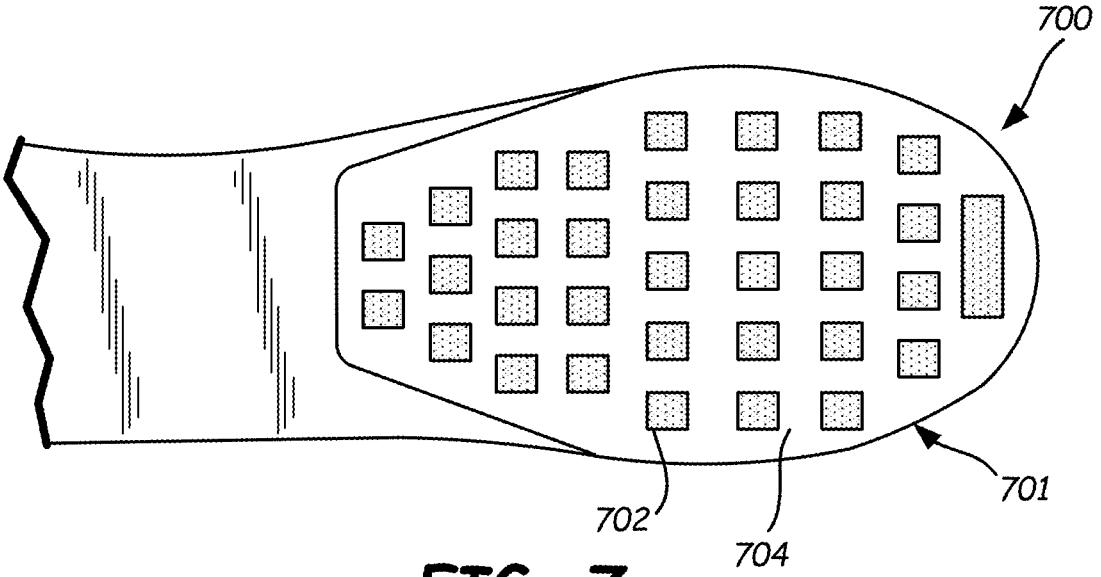
FIG. 7*a* is a bottom view of a variable friction shoe according to some embodiments.
Figure 8A:
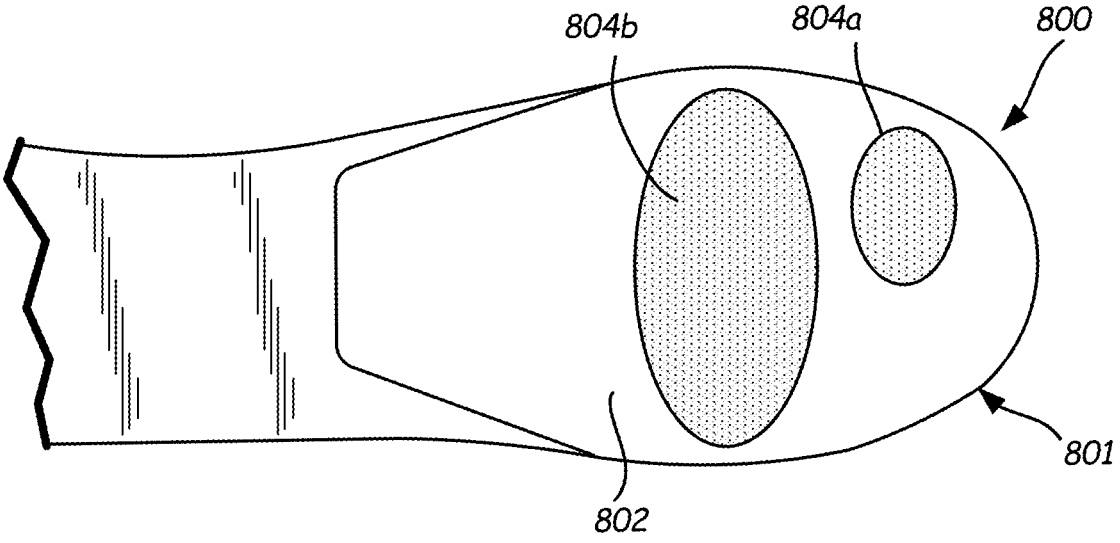
FIG. 8*a* is a bottom view of a variable friction shoe according to some embodiments.

In the embodiment shown in FIG. 5*a*, variable friction shoe 500 includes a midsole 510 and an outsole 502, which in turn includes a low-friction surface 504 and a high-friction surface 506. The low-friction surface 504 extends in a horse-shoe shape around the front portion of the outsole 502. During the swing stage of the gait, the low-friction surface 504 is prominent (i.e., remains proud relative to the high-friction surface 506). In the case of a scuff, the low-friction surface 504 allows the shoe to slide across the ground. The low-friction surface 504 (or adjacent compressible material) is compressed by the higher vertical GRFs provided during the stance stage of the gait to allow the high-friction surface 506 to become prominent (i.e., such that the low-friction surface 508 is no longer proud or protruding from the high-friction surface 506). In the embodiment shown in FIG. 5*a* the high-friction surface 506 is located in the center portion of the shoe, in the region between the horseshoe-shape of the low-friction surface 504. In other embodiments, the location of high-friction surface 506 and low-friction surface 504 relative to one another may be modified. For example, a modified arrangement is shown in FIG. 6, FIG. 7*a*, and FIG. 8*a*. In each however, the principle of operation remains the same. The low-friction surface 504 remains prominent during the swing portion of the gait when GRFs are relatively low and wherein the low-friction surface 504 recedes in response to increasing GRFs, resulting in the high-friction surface 506 of the outsole 502 coming into contact with the ground during the stance stage of the gait.

FIG. 5*b* is a side view of the variable friction shoe 500 in an uncompressed state and FIG. 5*c* is a side view of the variable friction shoe 500 in a compressed state. In response to little or no ground reaction force (GRF)—typical during the swing stage of the gait—the low-friction surface 504 is prominent (i.e., proud relative to the high-friction surface 506). As a result, the shoe is allowed to slide along the ground via the low-friction surface 504 without catching during the swing stage of the gait. As increasing GRFs are applied to the variable friction shoe 500 (in response to a transition to the stance stage of the gait) a compressible material (not visible) located vertically adjacent to the low-friction surface 504 is compressed as shown in FIG. 5*c*. As a result, the high-friction surface 506 becomes prominent and therefore contacts the ground, thereby preventing the shoe from slipping across the surface contacted.

For some applications, a benefit of the low-friction surface 504 being continuous or nearly continuous is that there are fewer sharp transitions between the low-friction surface 504 and the high-friction surface 506. In some embodiments, another benefit is the size of the low-friction surface 504 relative to the high-friction surface 506 prevents the low-friction surface 504 and/or high-friction surface 506 from getting caught in cracks during either stage of the gait. In some embodiments, the low-friction surface 504 is continuous. In other embodiments, the low-friction surface 504 is not continuous. For example, low-friction surface 504 may include a first low-friction surface and a second low-friction surface. For example, the embodiment shown in FIG. 6 illustrates the low-friction surface separated into first and second low-friction surfaces.

FIG. 6 is an exploded view of a variable friction shoe 600 that illustrates the plurality of layers utilized according to some embodiments. For the sake of simplicity, the top portion of the shoe is not shown in this view. In some embodiments, outsole 602 is the topmost layer and extends along the entire length of the variable friction shoe 600. In some embodiments, outsole 602 includes at least a first recess configured to receive at least a first compressible layer 604*a*. In the embodiment shown in FIG. 6, outsole 602 includes a first recess and a second recess located towards the front of the shoe, on opposite sides from one another. In other embodiments, first recess and second recess may be connected to one another, forming a single recess for example in a horseshoe shape positioned along the front of the shoe (for example, as shown in FIG. 5*a* in a horseshoe shape). In some embodiments, a compressible material 604*a*, 604*b* is located in the first and second recess respectively. In some embodiments, the compressible material 604*a*, 604*b* is more compressible than the outsole 602, such that the compressible material 604*a*, 604*b* compresses (more than outsole 602) in response to GRFs.

Adjacent to the outsole 602 and compressible layer 604*a*, 604*b* is an intermediate layer 606 that includes low-friction surface 608 (in this example, first and second low-friction surfaces 608*a*, 608*b*). In some embodiments, low-friction surfaces 608*a*, 608*b* are coextensive with compressible material 604*a*, 604*b* and the associated recesses. In other embodiments, low-friction surfaces 608*a*, 608*b* are slightly smaller in surface area than the corresponding compressible layers 604*a*, 604*b*. In some embodiments, intermediate layer 606 extends only along a front portion of the variable friction shoe 600. In some embodiments, low-friction surfaces 608*a*, 608*b* include a height or thickness (relative to bottom layer 610) that ensures low-friction surface 608*a*, 608*b* is protrudes beyond the bottom layer 610 in an uncompressed state. In some embodiments, low-friction surfaces 608*a* and 608*b* are made of the same material as intermediate layer 606. In some embodiments, low-friction surfaces 608*a* and 608*b* and intermediate layer 606 are integral. In other embodiments, low-friction surfaces 608*a* and 608*b* are made from different materials, wherein only low-friction surface 608*a* and 608*b* are comprised or present a low-friction surface.

The bottom layer 610 is positioned adjacent to the intermediate layer, wherein the intermediate layer is located between the bottom layer 610 and the outsole 602. In some embodiments, the bottom layer 610 is defined by a width that allows the bottom layer 610 to be positioned between the low-friction surface 608*a* and 608*b*. In some embodiments, the length of bottom layer 610 extends along the entire length of the outsole 602. In other embodiments, bottom layer 610 may extend along a portion of the outsole 602 (for example, as shown in FIG. 6). A high-friction surface 612 is located on the bottom surface of the bottom layer 610.

As described above, during the swing stage of the gait, when no GRF are applied to the variable friction shoe 600, the low-friction surfaces 608*a* and 608*b* remain prominent or proud relative to the high-friction surface 612. Incidental contact with the ground during this stage (e.g., scuffing) results in the low-friction surface 608*a* and/or 608*b* coming into contact with the ground, the low-friction surface allowing the shoe to slide along the ground and not catch. In response to increasing GRFs as the user transitions to the stance stage of the gait, the compressible layer 604*a*, 604*b* is compressed, resulting low-friction surface 608*a* receding from the position of prominence relative to the high-friction surface 612. As a result of the compression of the compressible layer 604*a* and 604*b*, high-friction surface 612 is brought into contact with the ground and provides the prevents the shoe from sliding along the ground/surface.

In the embodiment shown in FIG. 6, the compressible layer 604*a* and 604*b* and low-friction surface 608*a* and 608*b* are located on the outer and inner portion of the front portion of the shoe. In other embodiments, the location of these layers and surfaces may be modified depending on the application. For example, in some embodiments the compressible layer 604*a* and 604*b* and low-friction surface 608*a* and 608*b* may be continuous in the form of a horseshoe as shown, for example, in FIG. 5*a*-5*c*. In other embodiments-such as those described with respect to FIGS. 7*a*, 7*b* and 8*a*, 8*b*—other geometries may be utilized.

Figure 7B:
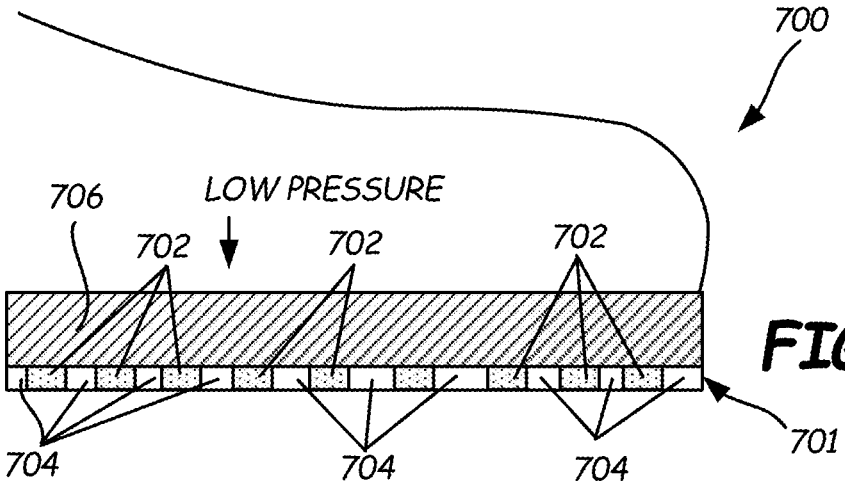
FIGS. 7*b* and 7*c* are side views of the variable friction shoe in an uncompressed state and a compressed state, respectively, according to some embodiments.
Figure 7C:
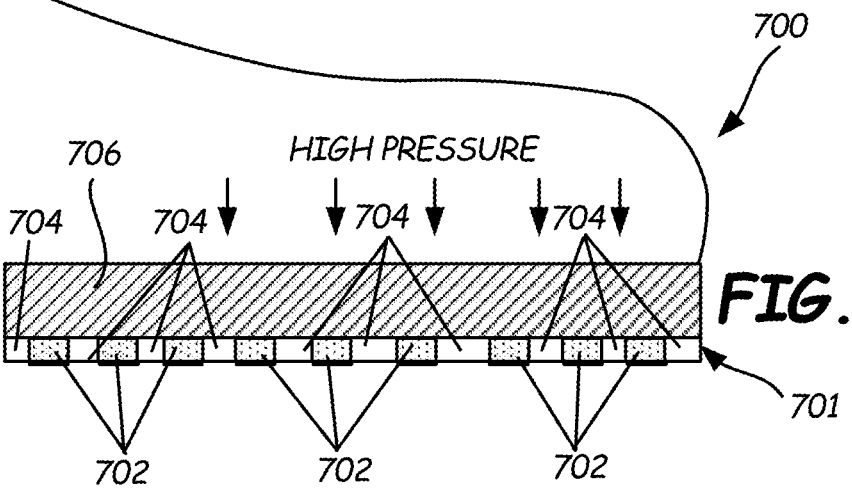
Figure 8B:
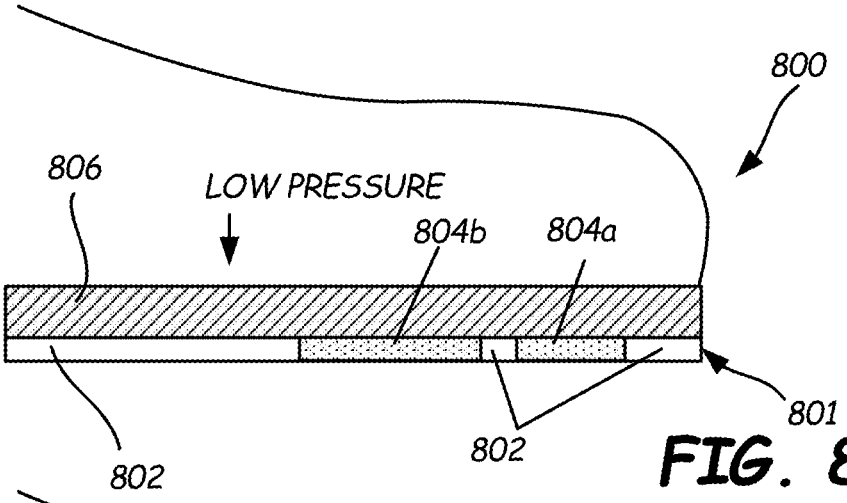
FIGS. 8*b* and 8*c* are side views of the variable friction shoe in an uncompressed state and a compressed state, respectively, according to some embodiments.
Figure 8C:
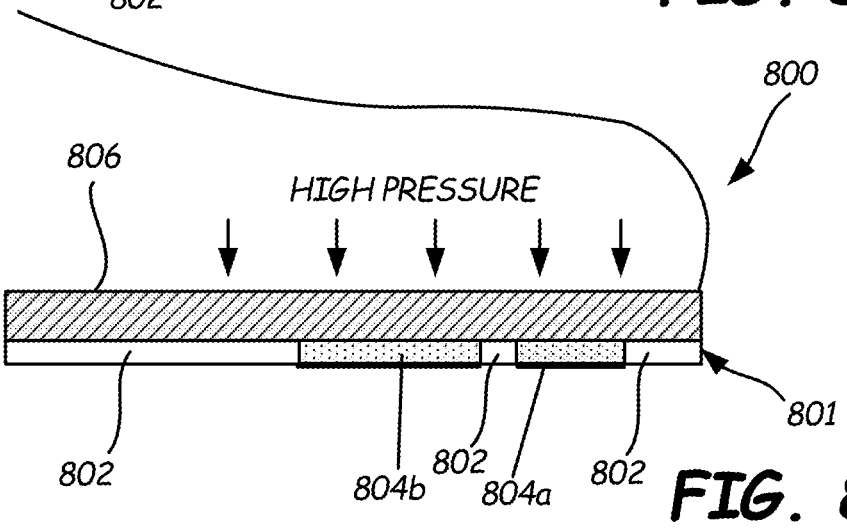

With respect to FIG. 7*a*-7*c*, a variable friction shoe 700 is provided with a different geometry of low-friction surfaces 704 and high-friction surfaces 702. In particular, FIG. 7*a* is a bottom view of the outsole 701 of the variable friction shoe 700 and FIGS. 7*b* and 7*c* are side views during an uncompressed and compressed state, respectively. In contrast with the embodiment shown in FIGS. 1*a* and 1*b*, the embodiment provided in FIGS. 7*a*-7*c* utilizes a plurality of islands of high-friction surfaces 702 separated from one another by a low-friction surface 704. As shown in FIGS. 7*b* and 7*c*, the low-friction surface 704 remains prominent relative to the plurality of islands of high-friction surfaces 702 when GRFs are low (i.e., during the swing stage of the gait) as shown in FIG. 7*b*. Compressible material (not shown) located between the low-friction surface 704 and the midsole is compressed in response to increasing GRFs. Conversely, non-compressible material (relative to the compressible material associated with the low-friction surface 704) is located vertically adjacent to each of the plurality of high-friction surfaces 702. In response to increasing vertical GRFs, the compressible material vertically adjacent to the low-friction surface 704 compresses wherein the non-compressible material vertically adjacent to the plurality of high-friction surfaces 702 does not compress. As a result, the plurality of high-friction surfaces 702 transition to a position prominent or at least co-extensive relative to the low-friction surface 704 as shown in FIG. 7*c*. In response to the increased force and compression the position of the low-friction surface 704 is modified relative to the plurality of high-friction surfaces 702 such that the low-friction surface 704 is no longer proud or protruding from the plurality of high-friction surfaces 702 during the stance stage of the gait. As shown in FIG. 7*c*. the high-friction surface 702 does not necessarily have to be prominent or proud relative to the low-friction surface 704, but positioned such that high-friction surface 702 is able to contact the ground With respect to FIGS. 8*a*-8*c*, a variable friction shoe 800 is provided with a different geometry of low-friction surfaces 802 and high-friction surfaces 804*a*, 804*b*. In particular, FIG. 8*a* is a bottom view of the outsole 801 of the variable friction shoe 800 and FIGS. 8*b* and 8*c* are side views during an uncompressed and compressed state, respectively. In contrast with the embodiment shown in FIGS. 1*a* and 1*b*, the embodiments provided in FIGS. 8*a*-8*c* utilizes a first high-friction surface or region 804*a* and a second high-friction surface or region 804*b* separated by a low-friction surface or layer 802. As shown in FIGS. 8*b* and 8*c*, the low-friction surface 802 remains prominent relative to the first and second high-friction surfaces or regions 804*a*, 804*b* when GRFs are low (i.e., during the swing stage of the gait) as shown in FIG. 8*b*. Compressible material (not show) located vertically adjacent to the low-friction surface 802 is compressed in response to increasing GRFs during the stance stage of the gait. Conversely, non-compressible material (relative to the compressible material) located vertically adjacent to the first and second high-friction surfaces 804*a* and 804*b* does not compress. As a result of the increased force and compression the position of the low-friction surface 802 is modified relative to the plurality of high-friction surfaces 804*a* and 804*b* such that the low-friction surface 802 is no longer proud or protruding from the plurality of high-friction surfaces 804*a* and 804*b* during the stance stage of the gait. As shown in FIG. 8*c*, the high-friction surfaces 804*a* and 804*b* do not necessarily have to be prominent or proud relative to the low-friction surface 802, but positioned such that one or both of the high-friction surfaces 804*a* and 804*b* are able to contact the ground While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A variable friction shoe comprising:

an outsole;

a compressible layer;

an intermediate layer;

a first high-friction surface; and a low-friction surface, wherein the intermediate layer includes the low-friction surface and is positioned adjacent the compressible layer, wherein the low-friction surface protrudes beyond the first high-friction surface when vertical ground reaction forces (GRFs) are low, and wherein compression of the compressible layer in response to increasing GRFs causes the low-friction surface to recede relative to the first high-friction surface.

2. The variable friction shoe of claim 1, wherein the low-friction surface includes a first low-friction surface portion and a second low-friction surface portion separate from the first low-friction surface portion.

3. The variable friction shoe of claim 2, wherein the first low-friction surface portion is located on an inner portion of the outsole and the second low-friction surface portion is located on an outer portion of the outsole.

4. The variable friction shoe of claim 1, wherein the first low-friction surface includes a plurality of low-friction surface portions, wherein each of the plurality of low-friction surface portions are associated with one of a plurality of compressible layers.

5. The variable friction shoe of claim 1, wherein the compressible layer is positioned within a recess defined in the outsole, and wherein the low-friction surface is positioned over the compressible layer within the recess.

6. The variable friction shoe of claim 1, wherein the low-friction surface is smaller in surface area than the compressible layer associated with the low-friction surface.

7. The variable friction shoe of claim 1, wherein the low-friction surface is made of the same material as the intermediate layer.

8. The variable friction shoe of claim 1, wherein the low-friction surface and the intermediate layer are made from different materials.

9. The variable friction shoe of claim 1, wherein the low-friction surface and the intermediate layer are integral.

10. A variable friction shoe comprising:

a compressible layer;

an intermediate layer;

a low-friction surface;

a high-friction surface;

an outsole; and a bottom layer, wherein the intermediate layer is located between the bottom layer and the outsole, wherein the low-friction protrudes beyond the high-friction surface when no ground reaction forces are applied.

11. The variable friction shoe of claim 10, wherein a high-friction surface is located on a bottom surface of the bottom layer.

12. The variable friction shoe of claim 10, wherein compression of the compressible layer in response to increasing ground reaction forces causes the high-friction surface to contact the ground.

13. The variable friction shoe of claim 12, wherein the high-friction surface prevents the variable friction shoe from sliding along the ground or surface.

14. The variable friction shoe of claim 10, wherein the low-friction surface includes a first low-friction surface and a second low-friction surface.

15. The variable friction shoe of claim 14, wherein the bottom layer is defined by a width that allows the bottom layer to be positioned between the first low-friction surface and the second low-friction surface.

* * * * *